US009272401B2

(12) United States Patent
Hon et al.

(10) Patent No.: US 9,272,401 B2
(45) Date of Patent: Mar. 1, 2016

(54) SPANNER TOOL

(75) Inventors: David Tak-Wei Hon, Shenzhen (CN); Jingfeng Li, Shenzhen (CN); Yiping Mo, Shenzhen (CN); Guangji Deng, Shenzhen (CN)

(73) Assignee: Dahon Technologies, LTD., Shenzhen, Guangdong (CN)

( * ) Notice: Subject to any disclaimer, the term of this patent is extended or adjusted under 35 U.S.C. 154(b) by 313 days.

(21) Appl. No.: 14/000,509

(22) PCT Filed: Feb. 20, 2012

(86) PCT No.: PCT/CN2012/071306

§ 371 (c)(1), (2), (4) Date: Oct. 28, 2013

(87) PCT Pub. No.: WO2012/113313

PCT Pub. Date: Aug. 30, 2012

(65) Prior Publication Data

US 2014/0033881 A1 Feb. 6, 2014

(30) Foreign Application Priority Data

Feb. 22, 2011 (CN) ..... 2011 1 0041714

(51) Int. Cl.

*B25B 23/142* (2006.01)
*B25B 23/00* (2006.01)
*B25G 1/06* (2006.01)

(52) U.S. Cl.

CPC ..... *B25B 23/0035* (2013.01); *B25B 23/0028* (2013.01); *B25B 23/1427* (2013.01); *B25G 1/063* (2013.01)

(58) Field of Classification Search

CPC ..... B25G 1/007; B25G 1/063; B25G 1/046; B25B 13/481; B25B 23/0028; B25B 23/0035; B25B 23/1427

USPC ..... 81/473, 73, 28, 37, 177.7, 177.8, 177.6

See application file for complete search history.

(56) References Cited

U.S. PATENT DOCUMENTS 1,642,569 A * 9/1927 Winslow ..... B23B 45/06 81/177.1
1,719,310 A * 7/1929 Rawlings ..... B25B 13/481 81/124.6

(Continued)

FOREIGN PATENT DOCUMENTS

CN 1927546 3/2007
CN 100484719 5/2009

*Primary Examiner* — Hadi Shakeri

(74) *Attorney, Agent, or Firm* — Colin P. Cahoon; Shaukat A. Karjeker; Carstens & Cahoon, LLP

(57) ABSTRACT

Disclosed is a spanner tool for mounting or dismounting components, which comprises a control piece (2), a connecting piece (1) and a rotating piece (3). The connecting piece (1) is hinged with one end of the control piece (2) and one end of the rotating piece (3) respectively. An angle β formed between the control piece (2) and the connecting piece (1) is less than an angle α formed between the rotating piece (3) and the connecting piece (1) when the control piece (2) and the rotating piece (3) respectively rotate to limit positions at different sides of the connecting piece (1). The spanner tool is practical and reliable. The spanner tool is convenient and rapid-in-use. The spanner tool can be folded for portability when not in use. Additionally, locking tightness of the tool can be adjusted by adjusting a nut.

13 Claims, 11 Drawing Sheets

(56) References Cited

U.S. PATENT DOCUMENTS 1,835,315 A * 12/1931 McLay ..... B25G 1/007 131/245
2,465,152 A * 3/1949 Ellison ..... B25G 1/005 81/121.1
3,882,753 A * 5/1975 Svensen ..... B25B 13/06 81/177.7
4,334,445 A * 6/1982 Timewell ..... B25G 1/063 81/177.7
4,974,477 A * 12/1990 Anderson ..... B25G 1/007 279/23.1
6,871,569 B1 * 3/2005 Chen ..... B25G 1/063 81/177.7
2010/0154604 A1 6/2010 Su

* cited by examiner

Section Plane B-B

SPANNER TOOL

TECHNICAL FIELD

The present application relates to a spanner tool, especially to a spanner tool for mounting or dismounting components.

BACKGROUND OF THE INVENTION

In the technology field of mechanism or in daily life, mounting or dismounting components is very common. The patent application with the application number of CN200610058779.8 and the title of "a spanner with swinging head and button structure" published on Mar. 14, 2007 that, the button structure of the spanner comprises a handle, a swinging head and a button; the handle comprises a first end and a second end; the first end is a turning portion, and the second part is provided with a pivot portion; the button is pivotally connected on the abdominal region of the swinging head and can make the swinging head swing pivotally, but the angles of the handle cannot be changed, and the handle cannot be turned quickly. The patent application with the application number of CN200510015991.1 and the title of "positioning structure for head pivotal swinging of a spanner" published on May 17, 2007 that, the working head can be positioned at any angles required; two working heads can even be realized, but the handle is not convenient for turning rapidly; what's more, two ends of the whole tool cannot be folded, so the spanner is too long to store easily; if the length of the rotating rod of the spanner is reduced, the spanner will be easy to store, but the long moment arm of force which is convenient for holding and rotating can no longer be obtained. The American patent application with the publication number of US20100154604 discloses a tool with adjustable working angle, as shown in a stereogram of the prior art in FIG. 1, the tool comprises a first rod, a second rod and a connecting member provided at both ends thereof with a first connecting portion and a second connecting portion; the first connecting portion is pivotally connected between the first clamping portions of the first rod, and the second connecting portion are pivotally connected between the two second clamping portions of the second rod; the head of the tool is provided at the other end of the second rod. As shown in a schematic diagram of the prior art in FIG. 2, when the tool is in the limiting position, the first rod and the second rod of the connecting member are approximately perpendicular to each other, therefore, a user needs to substantively swing his/her arm when mounting or dismounting components. The tool is time-consuming and laborious and has low efficiency in mounting or dismounting components.

SUMMARY OF THE INVENTION

A first objective of the present invention is to provide a spanner tool flexible and labour-saving.

A second objective of the present invention is to provide a spanner tool which can regulate the locking tightness.

A third objective of the present invention is to provide a spanner tool which is easy to store and portable.

The objectives of the present invention are achieved by the following technical schemes:

A spanner tool comprises a connecting piece, a control piece and a rotating piece; two ends of the connecting piece are respectively hinged with one end of the control piece and one end of the rotating piece; when the control piece and the rotating piece respectively turn to limiting positions at different sides of the connecting piece, an angle β formed between the control piece and the connecting piece is less than an angle α formed between the rotating piece and the connecting piece.

The connecting piece comprises an intermediate connecting rod; each of the two end faces of the intermediate connecting rod is provided with a chamfer, the two chamfers are disposed at different sides of an axis of the intermediate connecting rod; the control piece or the rotating piece can turn and get across a corresponding one of the chamfers, and is pressed against and positioned by the intermediate connecting rod; the two end faces of the intermediate connecting rod are right angle faces 118 respectively at the sides opposite to the chamfers; when it is turned to be on a straight line with the connecting piece, the control piece or the rotating piece is pressed against and positioned by the intermediate connecting rod.

The control piece is fixedly positioned when it is turned across the chamfer and gets perpendicular to the connecting piece; and the angle α formed between the rotating piece and the connecting piece is greater than 90 degrees and less than 180 degrees when the rotating piece is turned across the chamfer and gets fixedly positioned.

The rotating piece is fixedly positioned when it is turned across the chamfer and gets perpendicular to the connecting piece; the angle β formed between the control piece and the connecting piece is less than 90 degrees when the control piece is turned across the chamfer and gets fixedly positioned.

Two ends of the intermediate connecting rod are provided respectively with a first groove and a second groove; one end of the control piece is provided with a flat convex platform; the flat convex platform is provided with a round platform at its root; one end of the rotating piece is provided with a flat protuberance; the flat protuberance is provided with a platform at its root; and the flat protuberance and the flat convex platform respectively match with the first groove and the second groove.

The round platform of the control piece is provided with a nick at a side where the chamfer of the intermediate connecting rod is located; a notch is provided on an outer surface of the intermediate connecting rod for accommodating the nick of the round platform.

The intermediate connecting rod has an axially extending bore; an inner pressing spring and two intermediate pressing pins are disposed in the axially extending bore; and the two inner pressing pins are disposed at two sides of the inner pressing spring respectively, and extend through the axially extending bore partially to press against the control piece or rotating piece.

The rotating piece comprises a shell, a connecting block, a central spindle, an elastic element, an adjusting nut and rotating elements; one end of the connecting block is hinged with the connecting piece, the other end of the connecting block is provided with a platform; the central spindle is provided with a joint at one end and a cylindrical platform at the other end; the rotating elements are disposed between the platform of the connecting block and the platform of the central spindle; the elastic element and the adjusting nut are sleeved on the joint of the central spindle; the adjusting nut engages with the shell; and the elastic element is provided between the cylindrical platform of the central spindle and the adjusting nut.

Several grooves are evenly distributed on the platform of the connecting block; the cylindrical platform of the central spindle has several holes evenly distributed in its outer end face; and the rotating elements are placed in the holes.

One end of the rotating piece is provided with a first seat, which is provided with a second hinging hole and limit grooves; one end of the control piece is provided with a second seat, which is provided with a first hinging hole and positioning grooves; each end of the connecting piece is provided with a button; a spring is sleeved on a lower end of the button; an intermediate portion of the button is provided with a convex plate; and the convex plate matches with the limit grooves and the positioning grooves; and an upper end of the button extends through the connecting piece.

The spanner tool of the present invention is practical and reliable. During use, a user does not need to swing his/her arm and only needs to rotate his/her wrist to operate the spanner tool, so the spanner tool is convenient and rapid-in-use. The spanner tool can be folded for portability when not in use. Additionally, locking tightness of the tool can be adjusted by adjusting a nut.

DETAILED DESCRIPTION OF THE PREFERRED EMBODIMENT

The spanner tool of the present invention will be described in more details with reference to the accompanying Figures.

According to a first embodiment, as shown in FIGS. 5-15, the spanner tool comprises a connecting piece 1, a control piece 2 and a rotating piece 3. Two end of the connecting piece 1 are respectively hinged with one end of the control piece 2 and one end of the rotating piece 3.

Figure 12:
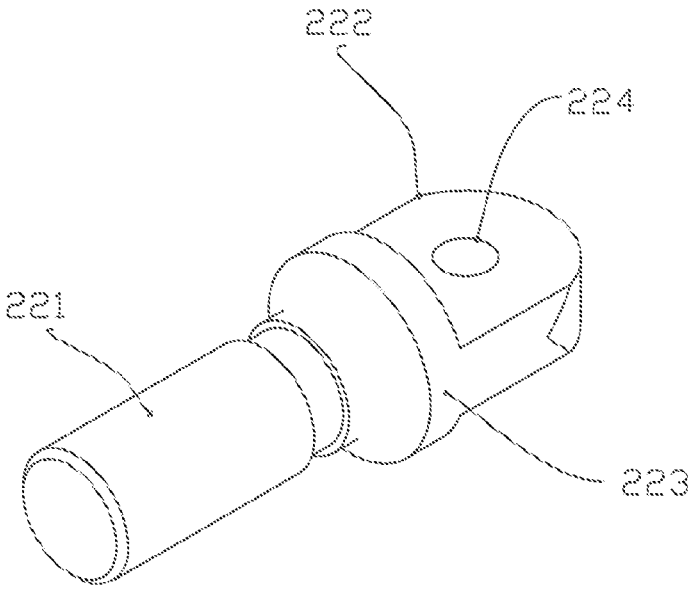
FIG. 12 is a stereogram illustrating a connecting rod for handle of the spanner tool of the present invention.

The control piece 2 comprises a handle 21 and a connecting rod 22 for handle. The handle 21 and the connecting rod 22 for handle can rotate relative to each other. The handle has concave-convex patterns thereon and may be made of special material, such as rubber, to increase frictional force when it is held and to prevent it from slipping from the hand of the user. As shown in FIG. 12, one end of the connecting rod 22 for handle is a cylinder 221, on which the handle 21 is sleeved; the other end of the connecting rod 22 for handle is provided with a flat convex platform 222; the flat convex platform 222 is provided with a round platform 223 at its root, and has a first hinging hole 224 thereon.

Figure 10:
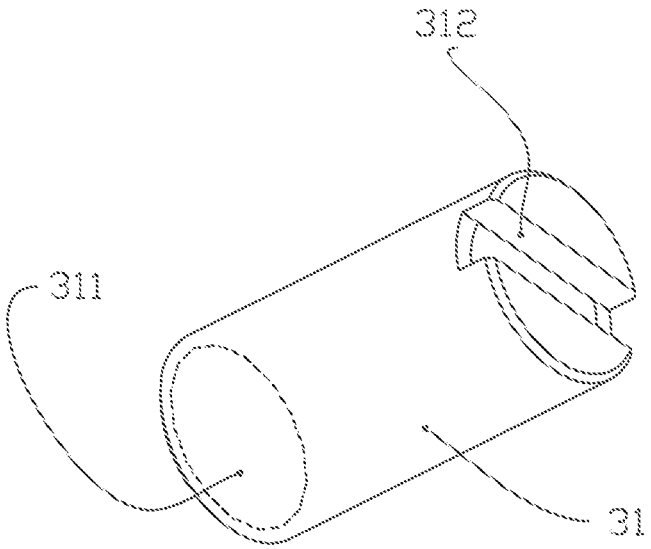
FIG. 10 is a stereogram illustrating a shell of the spanner tool of the present invention.
Figure 11:
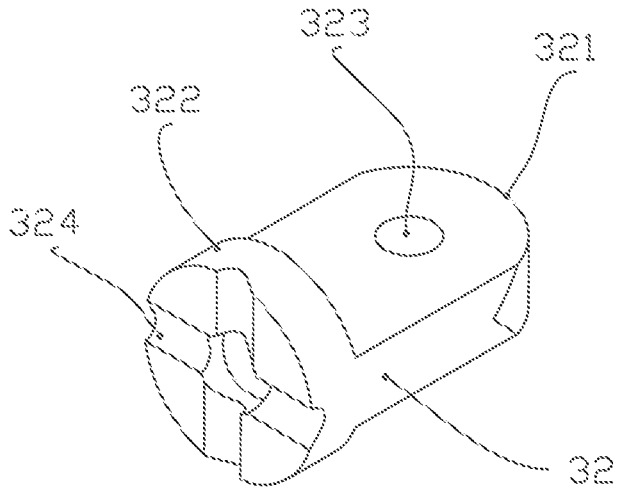
FIG. 11 is a stereogram illustrating a connecting block of the spanner tool of the present invention.
Figure 13:
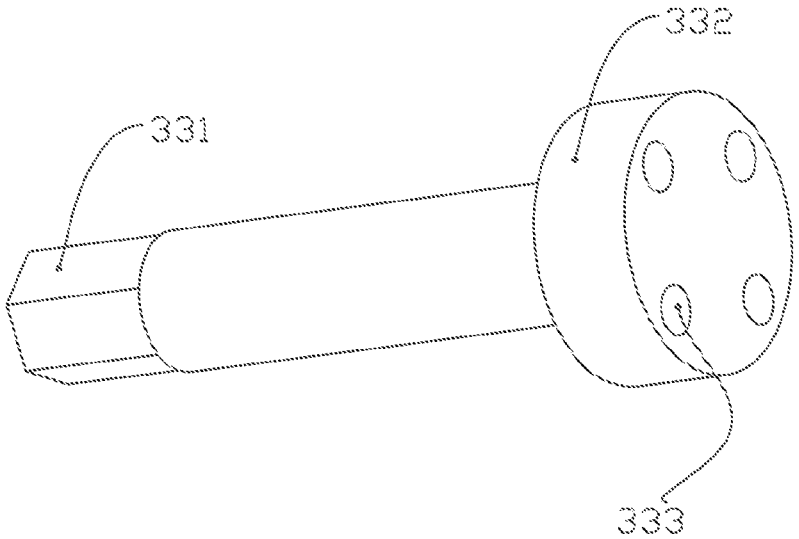
FIG. 13 is a stereogram illustrating a central spindle of the spanner tool of the present invention.
Figure 14:
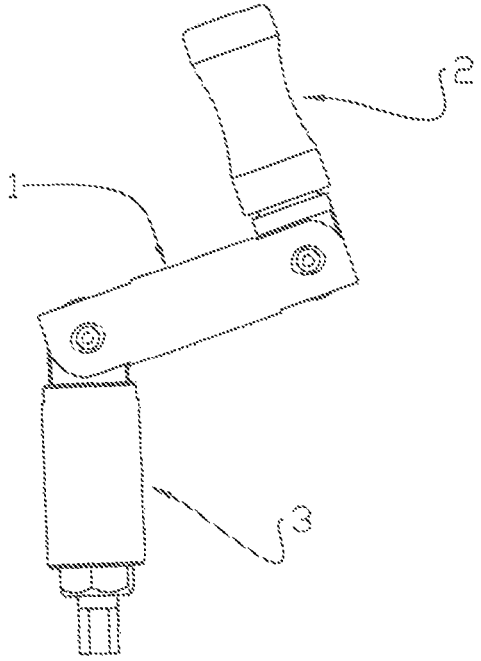
FIG. 14 is a schematic view illustrating a working status of the first embodiment of the spanner tool of the present invention.
Figure 15:
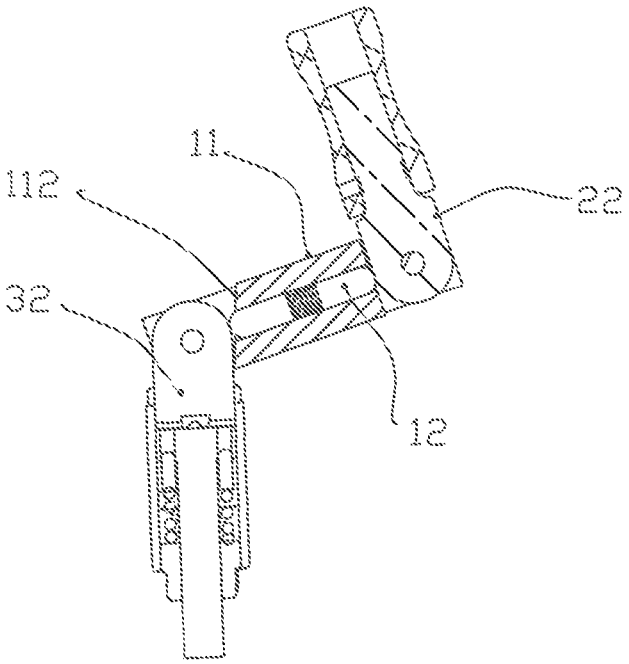
FIG. 15 is a sectional view of the working status of the first embodiment of the spanner tool of the present invention.

The rotating piece 3 comprises a shell 31, a connecting block 32, a central spindle 33, an elastic element 34, an adjusting nut 35, rotating elements 36 and a washer 37. As shown in FIG. 11, the connecting block 32 is provided with a flat protuberance 321, which has a second hinging hole 323 thereon; the root of the flat protuberance 321 is provided with a platform 322, the platform 322 has several grooves 324 evenly disposed at its outer end face. As shown in FIG. 10, the shell is hollow and has an opening on one end and a flat groove 312 on the other end. The connecting block 32 can go through the opening 311 of the shell 31, and the flat protuberance 321 of the connecting block 32 can extend through the flat groove 312 of the shell 31. The platform 322 of the connecting block 32 is encased in the shell 31. The shell 31 and the connecting block 32 cannot rotate relative to each other. As shown in FIG. 13, the central spindle 33 is provided with a joint 331 at one end and a cylindrical platform 332 at the other end; the cylindrical platform 332 has several holes 333 evenly disposed at its outer end face. The rotating elements 36 are placed in the holes 333 and extend through the holes partially, and can rotate on the outer end face of the platform 322 of the connecting block 32. The adjusting nut 35 is sleeved on the joint 331, and external threads of the adjusting nut 35 are engaged with internal threads of the shell 31. The elastic element 34 sleeved on the joint 331 is provided between the cylindrical platform 332 of the central spindle 33 and the adjusting nut 35. The flat protuberance 321 of the connecting block 32, the cylindrical platform 332 of the central spindle 33, the washer 37 and the elastic element 34 are all disposed inside the shell. The holes 333 distributed in the outer end face of the cylindrical platform 332 may be through holes, and the washer 37 may be provided correspondingly on the other end of the cylindrical platform 332 to exert a force upon the rotating elements 36. The elastic element 34, which may be a spring, a spring leaf or other elastic components, is provided between the washer 37 and the adjusting nut 35.

Figure 8:
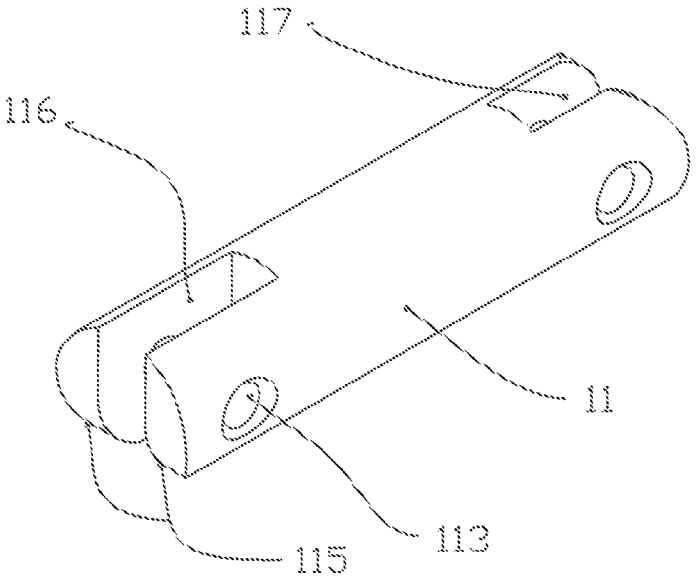
FIG. 8 is a stereogram illustrating an intermediate connecting rod of the spanner tool of the present invention.
Figure 9:
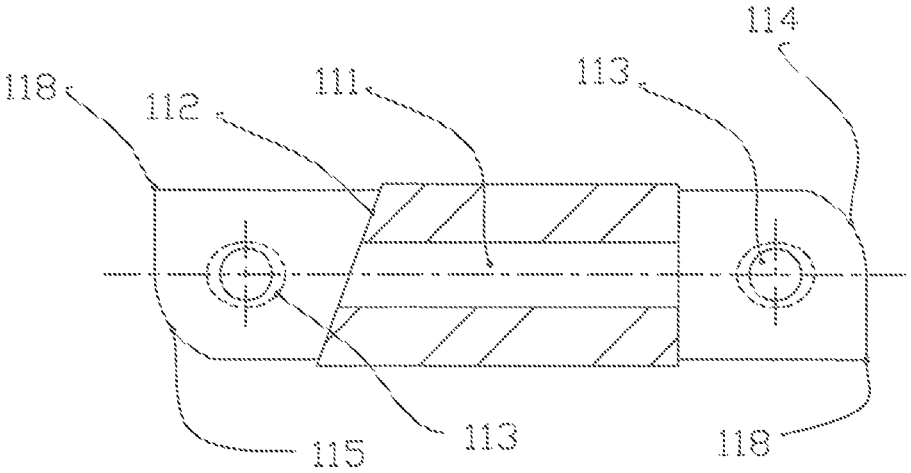
FIG. 9 is a sectional view of the intermediate connecting rod of the spanner tool of the present invention.

The connecting piece 1 comprises an intermediate connecting rod 11, an inner pressing spring 13, two inner pressing pins 12 and two shaft pins 14. The intermediate connecting rod 11 has an axially extending bore 111, and the inner pressing spring 13 and the two inner pressing pins 12 are disposed in the axially extending bore 111. The two inner pressing pins 12 are disposed at two sides of the inner pressing spring 13 respectively and extend partially out of the axially extending bore 111. As shown in FIGS. 8 and 9, two ends of the intermediate connecting rod 11 are provided with a first groove 116, a second groove 117 and third hinging holes 113; two end faces of the intermediate connecting rod 11 are provided with chamfers 114, 115, which are disposed at different sides of the axis of the intermediate connecting rod 11. The two end faces of the intermediate connecting rod 11 are in the form of right angle faces 118 respectively at the sides opposite to the chamfers. The first groove 116 matches with the flat protuberance 321 of the connecting block 32, which extends through the shell 31. The bottom of the first groove 116 is in the form of an inclined face 112, and the chamfer 115 is located at the side where the first groove 116 is shallower, namely, the chamfer 115 is at the same side as the higher side of the inclined face 112. One shaft pin 14 goes through the third hinging hole 113 in the first groove 116 of the intermediate connecting rod 11 and the second hinging hole 323 of the connecting block 32, so as to hinge the connecting piece 1 with the rotating piece 3. The end face of the shell 31 presses against the end face of the intermediate connecting rod 11, and the rotating piece 3 can only turn towards the side of the first groove 116 where the chamfer 115 is located, until the inclined face 112 presses against the lateral face of the flat protuberance 321 of the connecting block 32. The rotation angle of the rotating piece 3 relative to the connecting piece 1 is less than 90 degrees. The second groove 117 matches with the flat convex platform 222 of the connecting rod 22 for handle. One side of the second groove 117 is provided with the chamfer 114. The end face of the round platform 223 of the connecting rod 22 for handle presses against the end face of the intermediate connecting rod 11, and the connecting rod 22 for handle can only turn towards the side of the second groove 117 where the chamfer 114 is located, until the bottom of the second groove 117 presses against the lateral face of the flat convex platform 222 of the connecting rod 22 for handle. That is to say, the control piece 2 and the rotating piece 3 turn toward different sides of the connecting piece 1 when the control piece 2, the rotating piece 3 and the connecting piece 1 get on a straight line. Under the action of the inner pressing spring 13, the two inner pressing pins 12 respectively press against the flat protuberance 321 of the connecting block 32 and the flat convex platform 222 of the connecting rod 22 for handle, so that the control piece 2 and the rotating piece 3 will not get too loose when the control piece 2 and the rotating piece 3 respectively turn relative to the connecting piece 1, and the operating of the spanner tool will not be affected.

Figure 1:
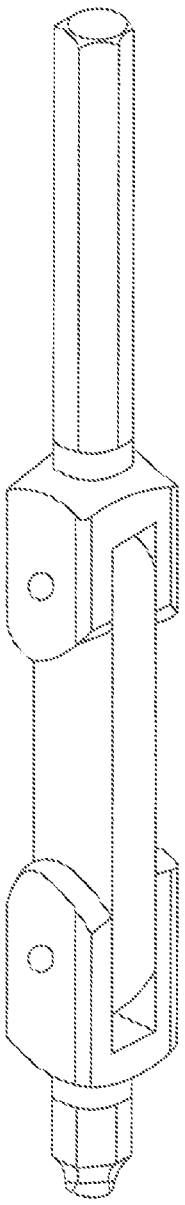
Figure 1 (Prior Art)
FIG. 1 is a stereogram of the prior art.
Figure 2:
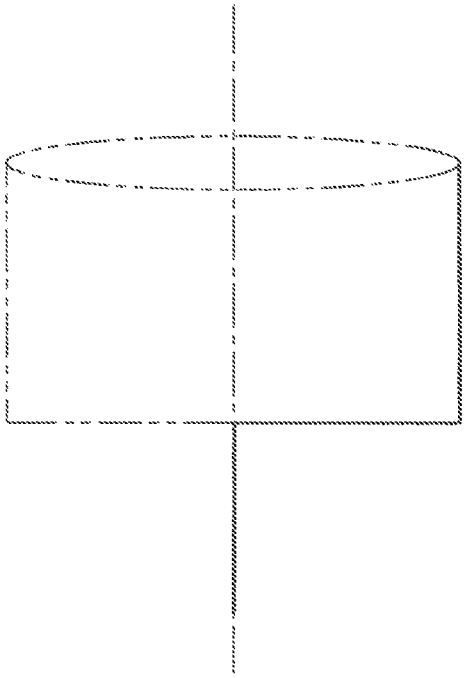
Figure 2 (Prior Art)
FIG. 2 is a schematic diagram of the prior art.
Figure 3:
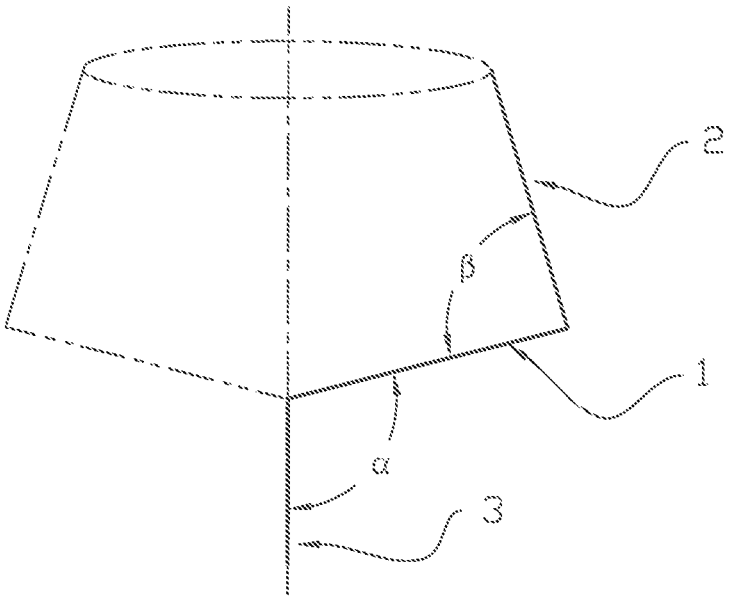
FIG. 3 is a schematic diagram illustrating the first embodiment of the spanner tool of the present invention.

According to the spanner tool of the first embodiment, when the control piece 2 and the rotating piece 3 respectively turn toward different sides of the connecting piece 1 to limiting positions, while the control piece 2, the rotating piece 3 and the connecting piece 1 are on a straight line, the angle $\alpha$ formed between the rotating piece 3 and the connecting piece 1 is greater than 90 degrees, and the angle $\beta$ formed between the control piece 2 and the connecting piece 1 is 90 degrees, so the free end of the control piece 2 inclines to the rotating piece 3. As shown in FIG. 3, the distance from the free end of the control piece to the straight line where the rotating piece is located is less than the distance from the hinged end of the control piece to the straight line where the rotating piece is located, therefore, a user can operate the spanner tool of the first embodiment only with his/her wrist and without substantially swinging his/her arm, so the spanner tool is convenient and quick-in-use. After the tightening target is tightened, if the user continues to exert a force upon the spanner tool, the counterforce that the tightening target exerts upon the joint 331 is greater than the friction force between the rotating elements 36 and the platform 322 of the connecting block 32; when the rotating elements 36 rotates on the platform 322 of the connecting block 32 and passes through the grooves 324 on the platform 322, there will be sounds indicating that the target has been tightened, so as to prevent the target from being tightened by the spanner tool excessively. The user can regulate the adjusting nut 35, so as to change the elastic force of the elastic element 34 pressed, to change the friction force between the rotating elements 36 and the platform 322 of the connecting block 32, and to set the tightening force of the spanner tool. By changing the shape of the grooves 324 on the platform 322, it is possible to make the rotating elements 36 turn in only one direction on the end face of the platform 322 of the connecting block 32, or that greater force is needed in driving the rotating elements 36 to turn in the converse direction on the end face of the platform 322 of the connecting block 32, in this case the spanner tool can be used for both mounting or dismounting components, for example, the profile of the section plane of the grooves 324 at the side in the direction of rotation is a moderating and smooth curve, and the profile at the other side is a curve with greater slope.

According to the spanner tool of the first embodiment, the shape of bottoms of the first groove 116 and the second groove 117 of the intermediate connecting rod 11 can be designed as required, such as to be an inclined plane or steps, provided that the angle $\beta$ formed between the control piece 2 and the connecting piece 1 is less than the angle $\alpha$ formed between the rotating piece 3 and the connecting piece 1 when the first groove 116 and the second groove 117 respectively press against the lateral face of the flat protuberance 321 of the connecting block 32 and the lateral face of the flat convex platform 222 of the connecting rod 22 for handle.

Figure 16:
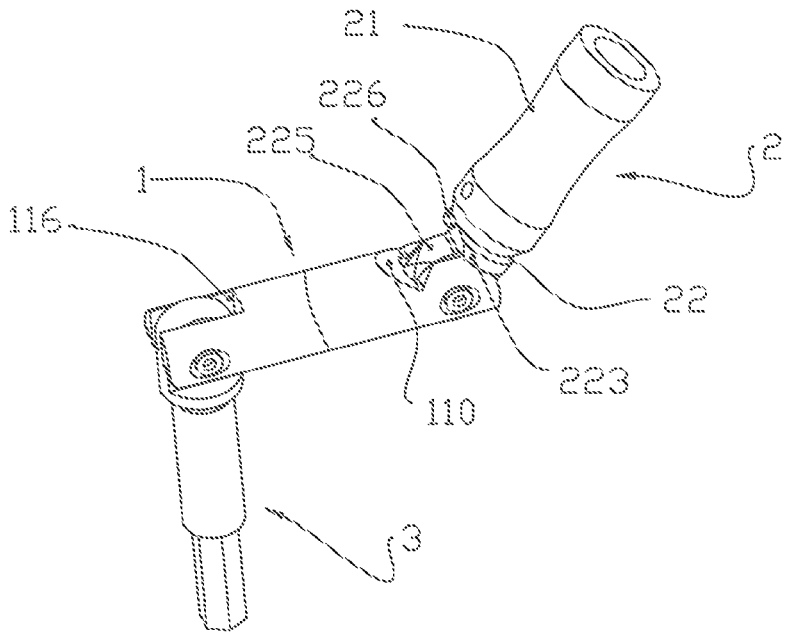
FIG. 16 is a stereogram illustrating the second embodiment of the spanner tool of the present invention.
Figure 17:
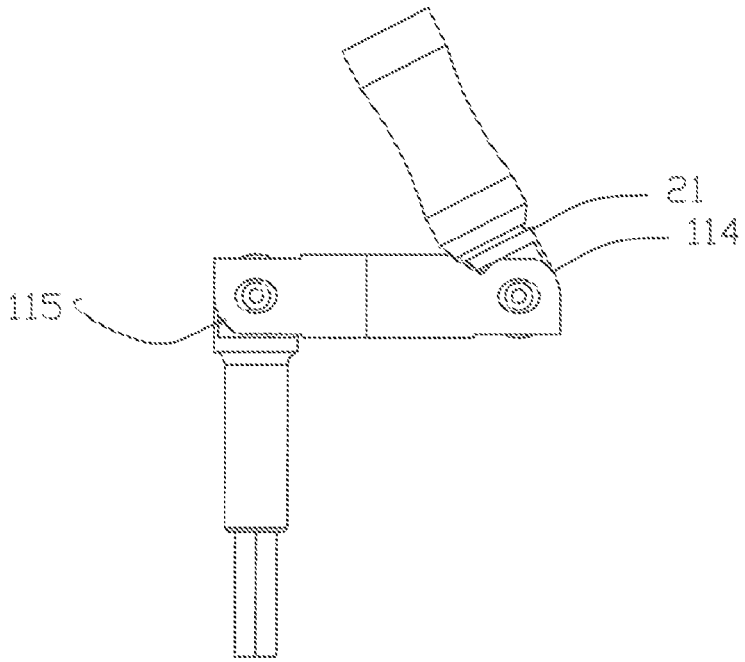
FIG. 17 is a schematic view illustrating a working status of the second embodiment of the spanner tool of the present invention.

According to the second embodiment, as shown in FIGS. 16 and 17, the spanner tool comprises a connecting piece 1, a control piece 2 and a rotating piece 3. The structures not denoted are just the same as those in the first embodiment.

The control piece 2 comprises a handle 21 and a connecting rod 22 for handle. The handle 21 and the connecting rod 22 for handle can rotate relative to each other. One end of the connecting rod 22 for handle is provided with the flat convex platform 222; the flat convex platform 222 is provided with a round platform 223 at its root and has a first hinging hole 224. The round platform 223 of the control piece 2 is provided with a nick 226 at the side where the chamfer of the intermediate connecting rod 11 is located, and the nick 226 can be seen when the connecting piece 1 and the control piece 2 are on a straight line.

One end of the rotating piece 3 is provided with the flat protuberance 321, which has the second hinging hole 323 thereon and is provided with the platform 322 at its root. The other end of the rotating piece 3 is provided with the joint 331.

Figure 4:
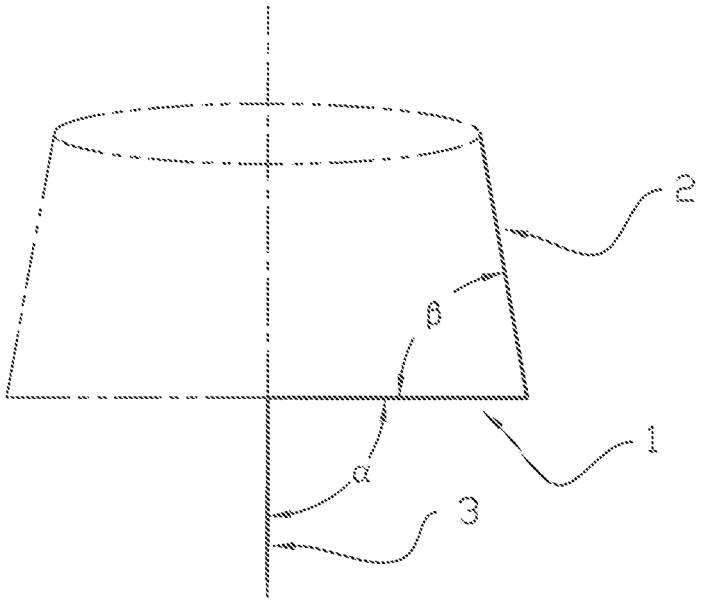
FIG. 4 is a schematic diagram illustrating the second embodiment of the spanner tool of the present invention.
Figure 5:
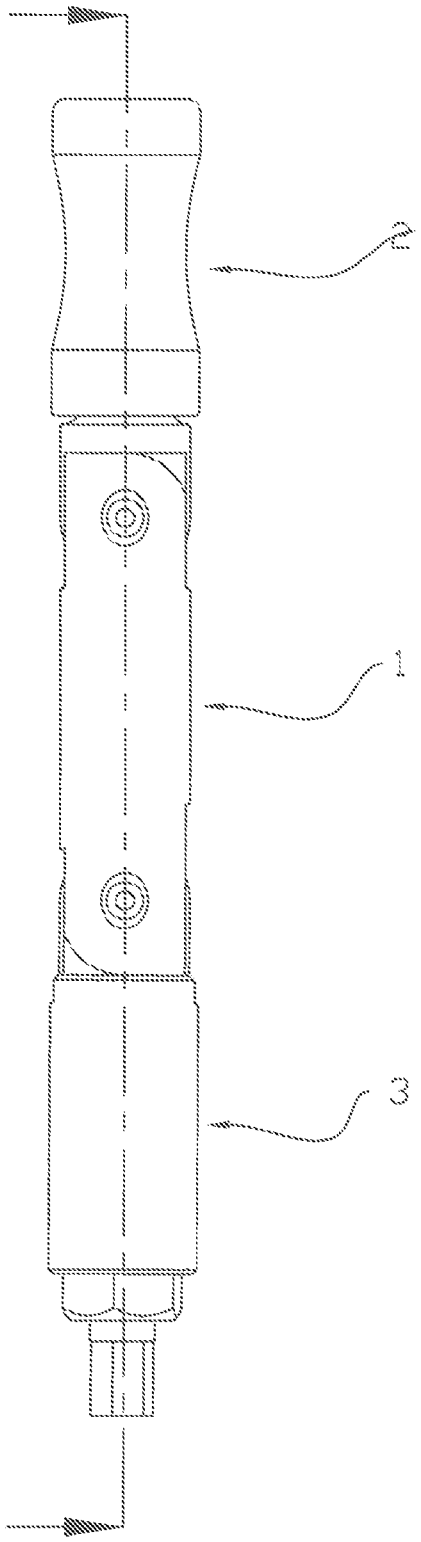
FIG. 5 is a front view of the first embodiment of the spanner tool of the present invention.
Figure 6:
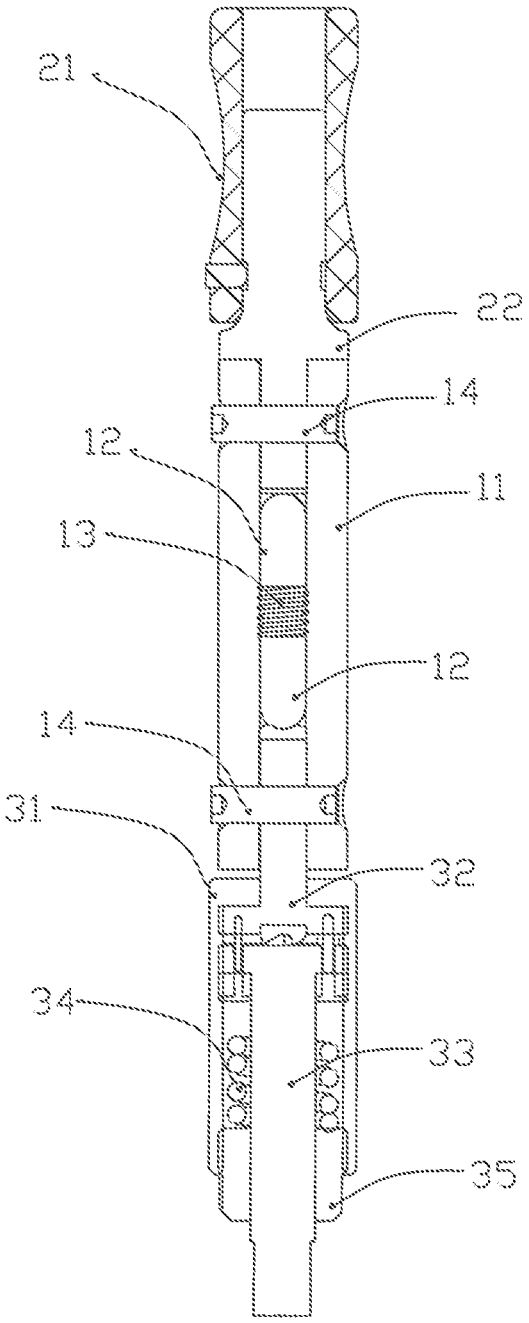
FIG. 6 is a sectional view of the first embodiment of the spanner tool of the present invention.
Figure 7:
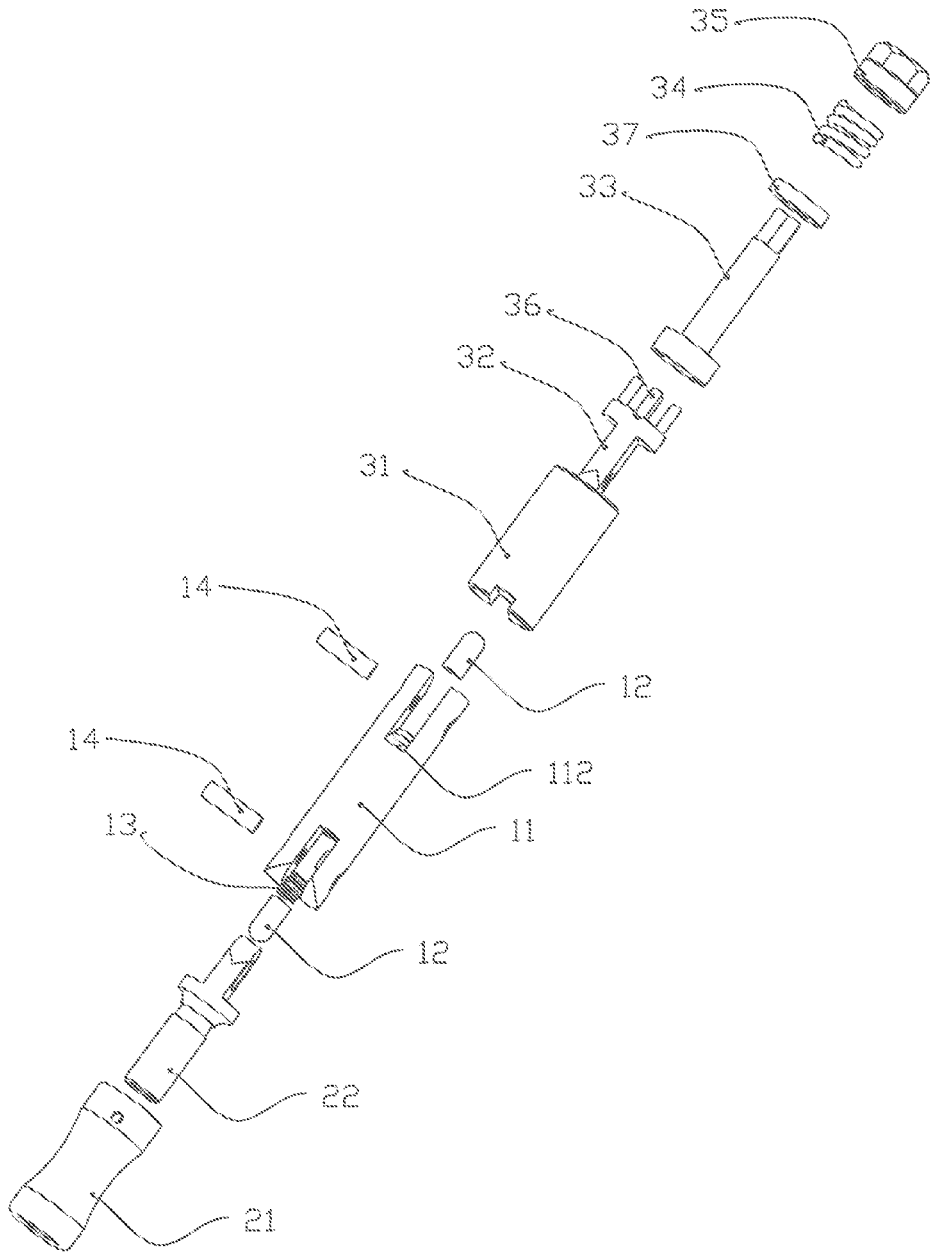
FIG. 7 is an exploded view of the first embodiment of the spanner tool of the present invention.

Two ends of the connecting piece 1 are respectively provided with the first groove 116, the second groove 117 and the third hinging holes 113. The chamfers 114, 115 are respectively provided on two end faces of the connecting piece 1 at the sides where the first groove 116 and the second groove 117 are located. The chamfers 114, 115 are located at different sides of the axis of the connecting piece 1. The two end faces of the intermediate connecting rod 11 are in the form of right angle faces 118 respectively at the sides opposite to the chamfers. The first groove 116 and the second groove 117 respectively match with the flat protuberance 321 and the flat convex platform 222, so that the first groove 116 is hinged with the flat protuberance 321 by one shaft pin 14, the second groove 117 is hinged with the flat convex platform 222 by another shaft pin 14. The rotating piece 3 can turn and get across the chamfer 115, and be pressed against and positioned by the intermediate connecting rod 11. When the control piece 2 or the rotating piece 3 turns to be on the same straight line where the connecting piece 1 is located, it is pressed against and positioned by the right angle face 118 at the corresponding end of the intermediate connecting rod 11. The second embodiment is different from the first embodiment in that: in the second embodiment, the bottom of the first groove 116 is level; the rotation angle of the rotating piece 3 relative to the connecting piece 1 is 90 degrees; the connecting rod 22 for handle can turn towards the side of the second groove 117 where the chamfer 114 is located; a notch 110 is provided on the outer surface of the connecting piece 1 for accommodating the nick 226 of the round platform 223, which makes the rotation angle of the control piece 2 relative to the connecting piece 1 greater than 90 degrees. As shown in FIG. 4, when the control piece 2 and the rotating piece 3 respectively turn to the limiting positions at different sides of the connecting piece 1, the angle β formed between the control piece 2 and the connecting piece 1 is less than 90 degrees, while the angle α formed between the rotating piece 3 and the connecting piece 1 is 90 degrees, so the distance from the free end of the control piece to the straight line where the rotating piece is located is less than the distance from the hinged end of the control piece to the straight line where the rotating piece is located. Therefore, the user can operate the spanner tool within relatively smaller area to mount or dismount bolts with the handle; the spanner tool is more flexible in use and more convenient for exerting force.

Figure 18:
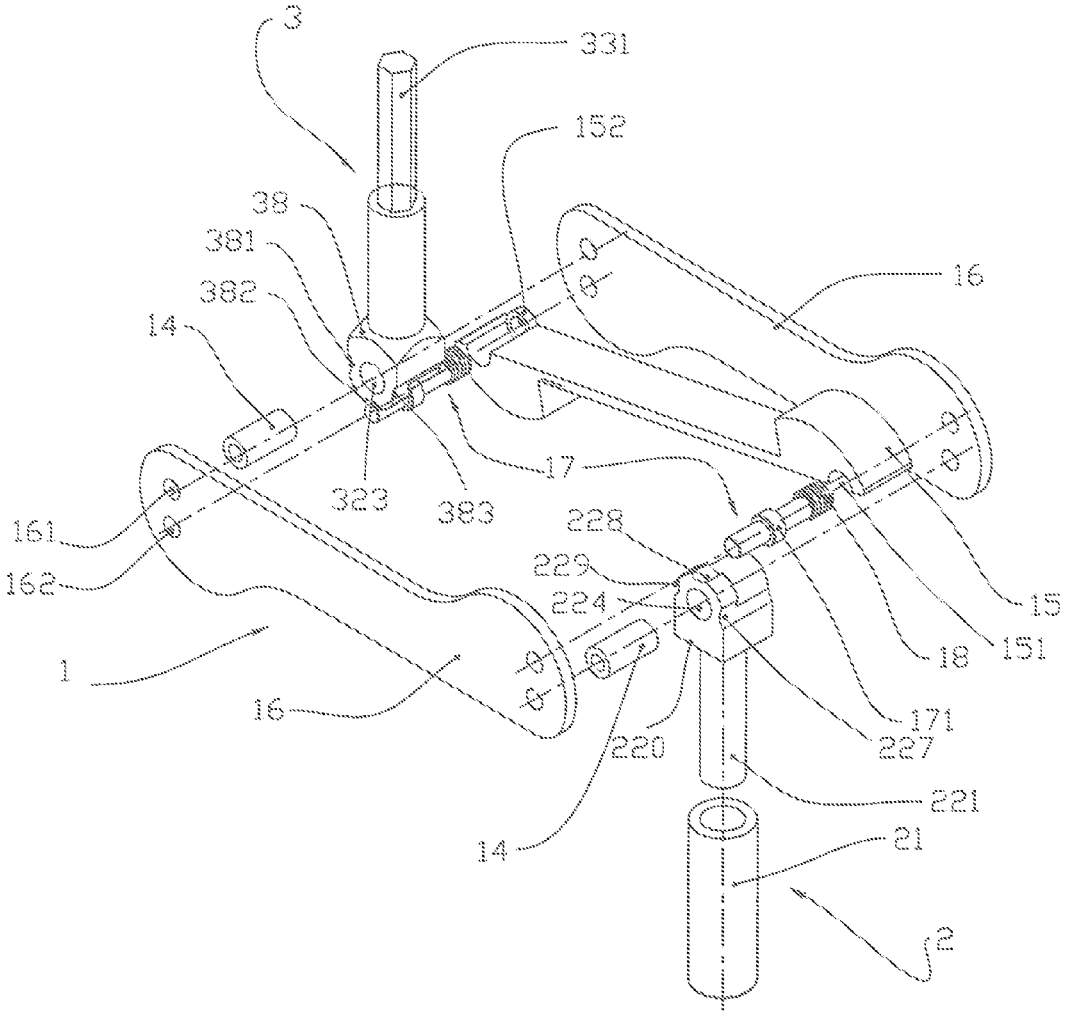
FIG. 18 is an exploded view illustrating the third embodiment of the spanner tool of the present invention.

According to the third embodiment, as shown in FIG. 18, the spanner tool comprises a connecting piece 1, a control piece 2 and a rotating piece 3. Two ends of the connecting piece 1 are respectively hinged with one end of the control piece 2 and one end of the rotating piece 3.

The connecting piece 1 comprises two parallel lateral plates 16, which have concave arc surfaces at their intermediate parts, for pulling out the control piece 2 and the rotating piece 3 easily by hand. A fourth hinging hole 161 and a second through hole 162 are provided at each end of the lateral plate 16. An inner padding block 15, each end of which is provided with a semi-circle groove 151, is disposed between the two lateral plates. One side of the semi-circle groove 151 is provided with a projecting lug 152. A button 17, an intermediate portion of which is provided with a convex plate 171, is disposed inside the semi-circle groove 151. One end of the button 17 goes through a spring 18 and the projecting lug 152 in turn and is set in the through hole 162 of one lateral plate. The spring 18 is disposed inside the convex plate 171 and the projecting lug 152, and the other end of the button 17 extends through the through hole 162 of the other lateral plate. The spring can be further pressed by pressing the end of the button 17 which extends through the through hole 162.

The rotating piece 3 is provided with a joint 331 on one end, and a first seat 38 on the other end. The first seat 38 is provided with a second hinging hole 323 and three limit grooves 381, 382, 383. The second hinging hole 323 is used for installing the shaft pin 14. Centers of the three limit grooves are disposed at regular distances along a semicircle, the center of the semicircle is the second hinging hole 323. Centers of the limit grooves 381, 383 and the second hinging hole 323 are disposed on a straight line. When the convex plate 171 is accommodated in the limit groove 381, the rotating piece 3 and the connecting piece 1 are outspreaded to be on a straight line; when the convex plate 171 is accommodated in the limit groove 382, the rotating piece 3 and the connecting piece 1 are perpendicular to each another; when the convex plate 171 is accommodated in the limit groove 383, the rotating piece 3 is in a state of being folded.

The control piece 2 comprises a handle 21 and a connecting rod 22 for handle. The handle 21 and the connecting rod 22 for handle can rotate relative to each other. One end of the connecting rod 22 for handle is a cylinder 221, on which the handle 21 is sleeved; the other end of the connecting rod 22 for handle is provided with a second seat 220, which is provided with a first hinging hole 224 and three positioning grooves 227, 228, 229. The first hinging hole 224 is used for installing the shaft pin 14. Centers of the limit grooves 227, 229 and the first hinging hole 224 are disposed on a straight line. The line connecting the center of the first hinging hole 224 and the center of the positioning grooves 228 forms an acute angle with the line connecting the center of the first hinging hole 224 and the center of the positioning grooves 229. When the convex plate 171 is accommodated in the positioning groove 227, the control piece 2 and the connecting piece 1 are outspreaded to be on a straight line, which contributes to lengthening the rotating tool to gain longer moment arm of force; when the convex plate 171 is accommodated in the positioning groove 229, the control piece 2 and the connecting piece 1 are in states of being folded; when the convex plate 171 is accommodated in the positioning groove 228, the control piece 2 and the connecting piece 1 are in common operating states, at this time, the angle between the control piece 2 and the connecting piece 1 is a an acute angle, namely, less than 90 degrees.

In another scheme for the third embodiment, the positions of the positioning grooves 227, 228, 229 and the limit grooves 381, 382, 383 are changed, so that the rotating piece 3 and the connecting piece 1 may have three kinds of relative positions, namely, the angle between the rotating piece 3 and the connecting piece 1 is 0 degree, an obtuse angle or 180 degrees, also the control piece 2 and the connecting piece 1 may have three kinds of relative positions, namely, the angle between the control piece 2 and the connecting piece 1 is 0 degree, 90 degrees or 180 degrees. Based on the principles of two schemes of the third embodiment, the function of the present invention can be implemented by designing the positions of the positioning grooves 227, 228, 229 and the limit grooves 381, 382, 383, and ensuring the angle β formed between the control piece 2 and the connecting piece 1 less than the angle α formed between the rotating piece 3 and the connecting piece 1.

It should be understood that the present invention is not restricted to the preferred embodiments. Various modifications or identical replacements may be made based on the structure, features and principles of the present invention without departing from the scope of the invention.

What is claimed is:

1. A spanner tool, comprising a connecting piece (1), a control piece (2) and a rotating piece (3);

wherein two ends of the connecting piece (1) are respectively hinged with one end of the control piece (2) and one end of the rotating piece (3); such that when the control piece (2) and the rotating piece (3) respectively turn to limiting positions at different sides of the connecting piece (1), an angle β formed between the control piece (2) and the connecting piece (1) is less than an angle α formed between the rotating piece (3) and the connecting piece (1);

wherein the rotating piece (3) comprises a shell (31), a connecting block (32), a central spindle (33), an elastic element (34), an adjusting nut (35) and rotating elements (36);

wherein one end of the connecting block (32) is hinged with the connecting piece (1), the other end of the connecting block (32) is provided with a platform (322); the central spindle (33) is provided with a joint (331) at one end and a cylindrical platform (332) at the other end; the rotating elements (36) are disposed between the platform (322) of the connecting block (32) and the platform (332) of the central spindle (33); the elastic element (34) and the adjusting nut (35) are sleeved on the joint (331) of the central spindle (33); the adjusting nut (35) engages with the shell; and the elastic element (34) is between the cylindrical platform (332) of the central spindle and the adjusting nut (35).

2. The spanner tool according to claim 1, wherein, the connecting piece (1) comprises an intermediate connecting rod (11); each of the two end faces of the intermediate connecting rod (11) is provided with a chamfer, the two chamfers are disposed at different sides of an axis of the intermediate connecting rod (11); the control piece (2) or the rotating piece (3) can turn and get across a corresponding one of the chamfers, and is pressed against and positioned by the intermediate connecting rod (11); the two end faces of the intermediate connecting rod (11) are right angle faces 118 respectively at the sides opposite to the chamfers; when it is turned to be on a straight line with the connecting piece (1), the control piece (2) or the rotating piece (3) is pressed against and positioned by the intermediate connecting rod (11).

3. The spanner tool according to claim 2, wherein, the control piece (2) is fixedly positioned when it is turned across the chamfer and gets perpendicular to the connecting piece (1); and the angle a formed between the rotating piece (3) and the connecting piece (1) is greater than 90 degrees and less than 180 degrees when the rotating piece (3) is turned across the chamfer and gets fixedly positioned.

4. The spanner tool according to claim 3, wherein, two ends of the intermediate connecting rod (11) are provided respectively with a first groove and a second groove; one end of the control piece (2) is provided with a flat convex platform (222); the flat convex platform (222) is provided with a round platform (223) at its root; one end of the rotating piece (3) is provided with a flat protuberance (321); the flat protuberance (321) is provided with a platform (322) at its root; and the flat protuberance (321) and the flat convex platform (222) respectively match with the first groove (116) and the second groove (117).

5. The spanner tool according to claim 3, wherein, the intermediate connecting rod (11) has an axially extending bore (111); an inner pressing spring (13) and two intermediate pressing pins (12) are disposed in the axially extending bore (111); and the two inner pressing pins (12) are disposed at two sides of the inner pressing spring (13) respectively, and extend through the axially extending bore (111) partially to press against the control piece (2) or rotating piece (3).

6. The spanner tool according to claim 2, wherein, the rotating piece (3) is fixedly positioned when it is turned across the chamfer and gets perpendicular to the connecting piece (1); the angle β formed between the control piece (2) and the connecting piece (1) is less than 90 degrees when the control piece (2) is turned across the chamfer and gets fixedly positioned.

7. The spanner tool according to claim 6, wherein, two ends of the intermediate connecting rod (11) are provided respectively with a first groove and a second groove; one end of the control piece (2) is provided with a flat convex platform (222); the flat convex platform (222) is provided with a round platform (223) at its root; one end of the rotating piece (3) is provided with a flat protuberance (321); the flat protuberance (321) is provided with a platform (322) at its root; and the flat protuberance (321) and the flat convex platform (222) respectively match with the first groove (116) and the second groove (117).

8. The spanner tool according to claim 6, wherein, the intermediate connecting rod (11) has an axially extending bore (111); an inner pressing spring (13) and two intermediate pressing pins (12) are disposed in the axially extending bore (111); and the two inner pressing pins (12) are disposed at two sides of the inner pressing spring (13) respectively, and extend through the axially extending bore (111) partially to press against the control piece (2) or rotating piece (3).

9. The spanner tool according to claim 2, wherein, two ends of the intermediate connecting rod (11) are provided respectively with a first groove and a second groove; one end of the control piece (2) is provided with a flat convex platform (222); the flat convex platform (222) is provided with a round platform (223) at its root; one end of the rotating piece (3) is provided with a flat protuberance (321); the flat protuberance (321) is provided with a platform (322) at its root; and the flat protuberance (321) and the flat convex platform (222) respectively match with the first groove (116) and the second groove (117).

10. The spanner tool according to claim 9, wherein, the round platform (223) of the control piece (2) is provided with a nick (226) at a side where the chamfer of the intermediate connecting rod (11) is located; a notch (110) is provided on an outer surface of the intermediate connecting rod (11) for accommodating the nick (226) of the round platform (223).

11. The spanner tool according to claim 2, wherein, the intermediate connecting rod (11) has an axially extending bore (111); an inner pressing spring (13) and two intermediate pressing pins (12) are disposed in the axially extending bore (111); and the two inner pressing pins (12) are disposed at two sides of the inner pressing spring (13) respectively, and extend through the axially extending bore (111) partially to press against the control piece (2) or rotating piece (3).

12. The spanner tool according to claim 1, wherein, several grooves (324) are evenly distributed on the platform (322) of the connecting block (32); the cylindrical platform (332) of the central spindle (33) has several holes (333) evenly distributed in its outer end face; and the rotating elements (36) are placed in the holes (333).

13. The spanner tool according to claim 1, wherein, one end of the rotating piece (3) is provided with a first seat (38), which is provided with a second hinging hole (323) and limit grooves; one end of the control piece (2) is provided with a second seat (220), which is provided with a first hinging hole (224) and positioning grooves; each end of the connecting piece (1) is provided with a button (17); a spring (18) is sleeved on a lower end of the button (17); an intermediate portion of the button (17) is provided with a convex plate (171); and the convex plate (171) matches with the limit grooves and the positioning grooves; and an upper end of the button (17) extends through the connecting piece (1).

* * * * *